United States Patent [19]

Hart et al.

[11] 4,027,362

[45] June 7, 1977

[54] BUCKLES FOR VEHICLE SAFETY BELTS

[75] Inventors: John Michael Hart; James Shadrach Varah, both of Carlisle, England

[73] Assignee: Kangol Magnet Limited, London, England

[22] Filed: May 2, 1975

[21] Appl. No.: 574,108

[30] Foreign Application Priority Data

May 2, 1974 United Kingdom ..... 19425/74

[52] U.S. Cl. ..... 24/230 AL

[51] Int. Cl.[2] ..... A44B 11/26; A44B 17/00

[58] Field of Search ..... 24/230 AL, 230 AN

[56] References Cited

UNITED STATES PATENTS

| | | | |
|---|---|---|---|
| 3,203,065 | 8/1965 | Hoppenstand | 24/230 AL |
| 3,242,547 | 3/1966 | Krengel | 24/230 AL |
| 3,522,640 | 8/1970 | Lohr | 24/230 AL |
| 3,760,467 | 9/1973 | Lohr | 24/230 AL |
| 3,763,523 | 10/1973 | Lindblad | 24/230 AL |
| 3,789,492 | 2/1974 | Klink | 24/230 AL |
| 3,795,030 | 3/1974 | Yates | 24/230 AL |
| 3,807,000 | 4/1974 | Weman | 24/230 AL |
| 3,895,196 | 7/1975 | Lewis | 24/230 A |

*Primary Examiner*—Bernard A. Gelak
*Attorney, Agent, or Firm*—Young & Thompson

[57] ABSTRACT

A two-part vehicle safety buckle has an integral metal pressing with a flat base and overturned side walls defining a socket. A latch assembly extends around the pressing and is guided in cut-outs in the side walls and base for manual release movement generally at right angles to the base from a latch position in which a latch portion protrudes through an aperture in the base to engage a latching edge in a flat tongue received in the socket. One or more springs act between the latch assembly and the pressing or a housing. Release movement may be by direct actuation or through a pivotable or slidable release member acting on the latch assembly. A spring urged ejection member may oppose entry and assist withdrawal of the tongue, and may actuate a microswitch to indicate that an associated seat belt is in use.

7 Claims, 12 Drawing Figures

Fig. 4
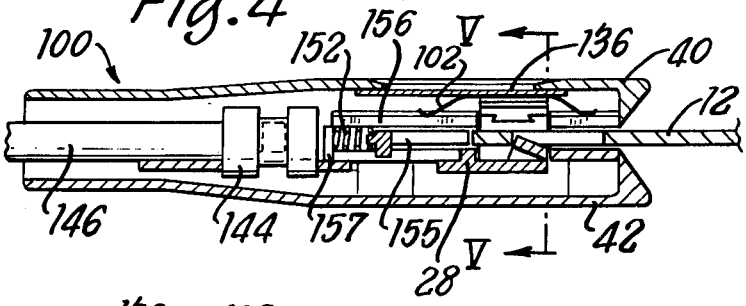
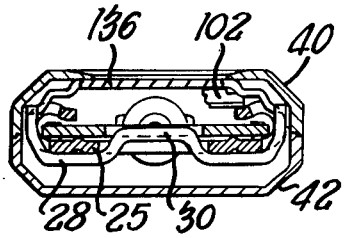
Fig. 5
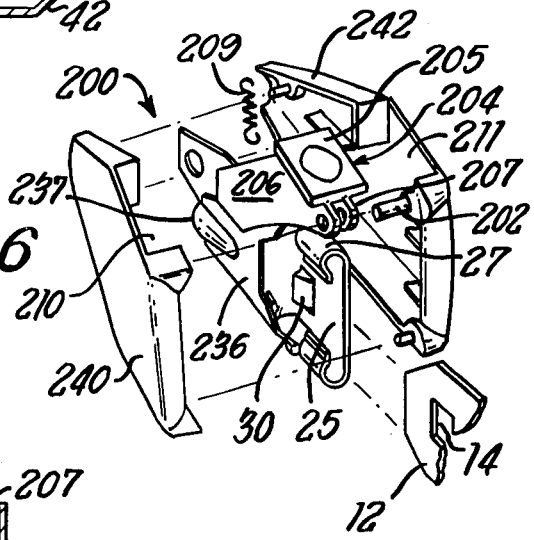
Fig. 6
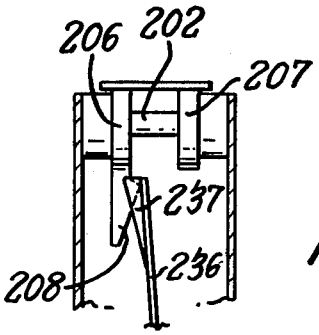
Fig. 7

BUCKLES FOR VEHICLE SAFETY BELTS

The invention relates to a buckle suited particularly for use as a vehicle safety belt buckle, and having a socket portion within which a tongue portion can be releasably latched.

A variety of buckles of this general kind are known but they all suffer from one or more disadvantages for example they are of complicated structure or require a large number of component parts, with consequent difficulties and high expense of production and assembly.

It is accordingly an object of the present invention to provide a buckle of this kind which comprises only a few parts which are of simple forms so that they can be readily produced and assembled, to obtain a buckle structure which exhibits great strength and reliability of operation.

It is a further object of the invention to provide a basic buckle structure which can be readily employed in or adapted to a variety of buckle forms differing for example as regards means of release by the user, and means of connection to a vehicle anchorage position.

The invention accordingly provides a buckle for a vehicle seat belt system, the buckle having a socket portion within which a tongue portion can be releasably latched, the socket portion comprising means defining a socket for receiving the tongue portion, and a latch means extending around the socket means and guided thereby for movement between a latching position in which a latch portion of the latch means extends into the socket for latching engagement with a formation of the tongue and a release position in which the tongue portion can be withdrawn from the socket.

For ease of manufacture, the socket means preferably comprises an integral metal pressing having a plate with side walls curving upwardly from a pair of parallel edges thereof and then towards each other to define the socket.

So that the latch means may be guided in a simple way and so that forces applied thereto may be directly transmitted to the socket means, the latch means preferably has side portions extending perpendicularly to the socket plate and engaging the socket means to slidably guide the latch means for movement perpendicularly to the plate. There may be gaps in the plate and/or the side walls slidably receiving the side portions of the latch means.

The latch means may have a release portion which is directly manually actuable to move the latch means, but the buckle can be readily modified if desired to have a release member mounted for movement manually from a rest position in which the latch means is in its latching position and to an operative position in which the release member has effected movement of the latch means to its release position.

The socket portion may have or be connected to an element for attachment of a length of webbing or may be secured to an end of a flexible cable of which the other end is arranged to be connected to a vehicle anchorage position.

The invention will be more readily understood from the following description and the accompanying drawings which relate to certain preferred embodiments of the invention. The description and drawings are illustrative of the invention, which may be readily embodied in other ways.

In the drawings:

FIG. 4 is a sectional side view of the socket and tongue portions of a second buckle embodying the invention;

FIG. 5 is a cross-sectional view of the buckle of FIG. 4;

FIG. 6 is an exploded perspective view of a third buckle embodying the invention;

FIG. 7 shows a detail of the buckle of FIG. 6;

Throughout the drawings, like parts are indicated by the same reference numerals.

Each of the illustrated buckles comprises a tongue portion, shown in FIGS. 4, 5, 6 and 8, having a tongue 12 with a tapered free end and a central aperture providing a latching edge 14 adjacent the free end. The tongue portion is also apertured remotely from the free end to receive the end of the lap and/or the diagonal portion of a safety belt, or a continuous length of webbing providing both portions.

Figure 1:
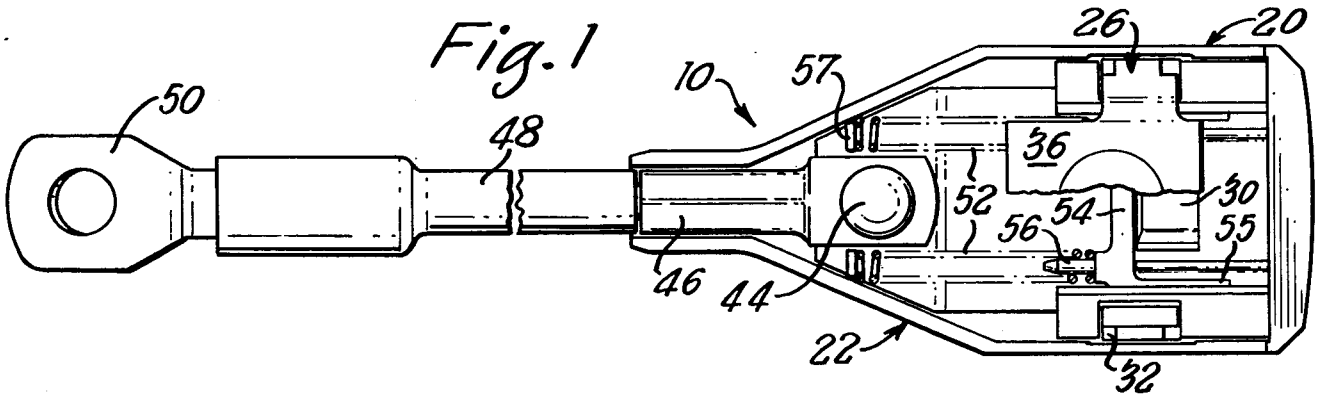
FIG. 1 is a plan view with parts broken away of the socket portion of a first buckle embodying the invention.
Figure 2:
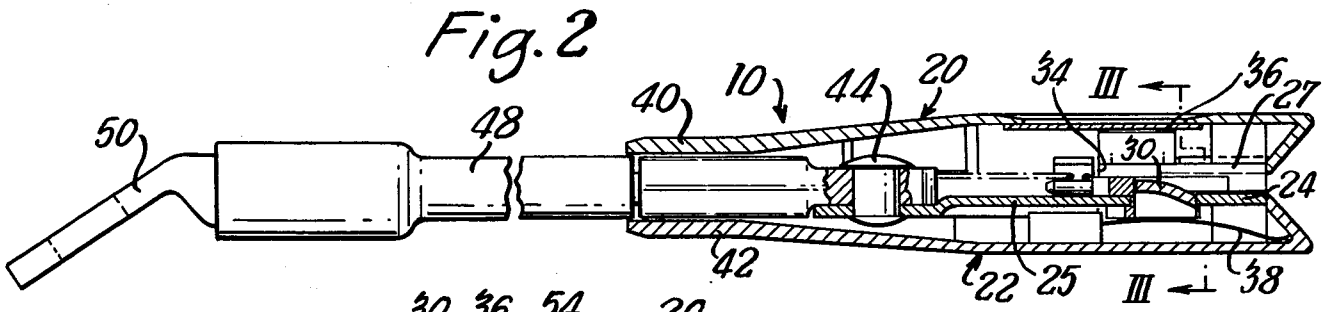
FIG. 2 is a mainly sectional side view of the buckle socket portion of FIG. 1.
Figure 3:
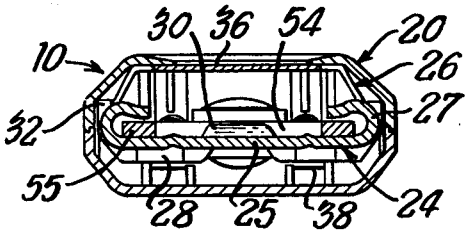
FIG. 3 is a cross-sectional view of the buckle socket portion of FIGS. 1 and 2.
Figure 3A:
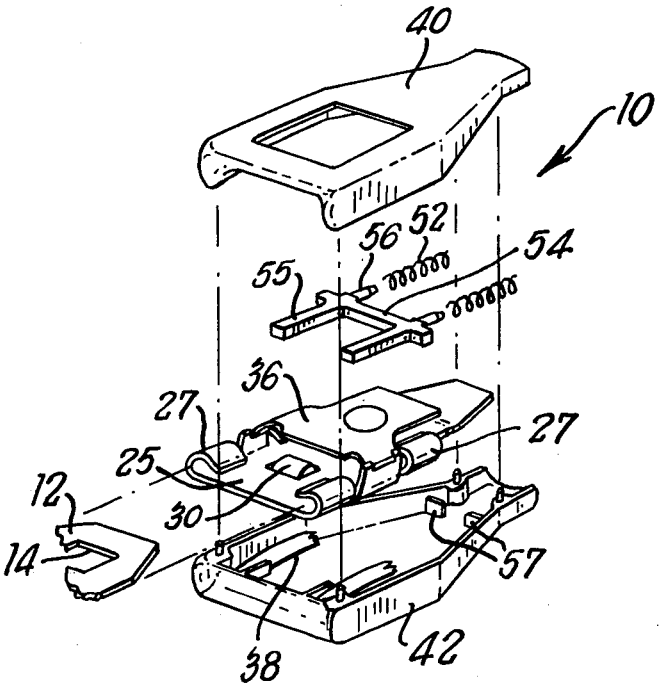
FIG. 3A is an exploded perspective assembly view of the inner elements of the device of FIGS. 1–3.

The buckle 10 shown in FIGS. 1, 2 and 3 also has a socket portion 20 comprising a housing 22, a frame member 24 and a latch assembly 26. The frame member 24 has the form of a metal pressing with a flat rectangular floor 25 having coined and/or rolled side walls 27 along two opposed sides of the floor.

The side walls together with the floor 25 form a socket for receiving the tongue 12. The side walls 27 extend from the end of the frame member 24 corresponding to the open end of the socket but have transversly aligned gaps 34.

Beneath the guide member there is located a latch plate 28 with an upwardly struck or deformed latch portion 30 normally projecting through an aperture in the guide member floor for engagement with the latching edge of 14 the tongue 12. The latch plate 28 also has upwardly extending side portions 32 by which it is guided, for movement generally at right angles to the plane of the floor 25, in the gaps 34 in the walls 27.

The latch plate 28 is connected to a release member 36 to complete the latch assembly 26. The release member 36 is a generally U-shaped pressing or moulding of synthetic plastics material with side formations by which it is permanently secured to the latch plate 28.

The latch assembly 26 is normally maintained in the latching position shown by spring means acting between the assembly and the housing 22. The spring means illustrated comprises a pair of leaf springs 38 one on either side of the latch portion 30. Other forms of spring means for example, a barrel or conical coil spring can be employed between the housing and the latch assembly.

The housing 22 comprises an upper case 40 and a lower case 42 both of moulded A.B.S. (acrylonitrile butadiene styrene) or other suitable material, with internal ribbing to locate the frame member 24 and the release member 36. Adjacent the end of the frame member 24 to which the side walls 27 extend the cases 40, 42 provide an inwardly tapering mouth leading to the socket of the frame member. The upper case 40 is apertured to expose the outer surface of the release member 26 for direct manual actuation to release the tongue 12 against the action of the leaf springs 38. The upper and lower cases 40, 42 are secured by ultrasonic welding as a final assembly step.

The end of the frame member 24 remote from the socket is shaped for secure connection, by means of a rivet 44, to a flexible cable 46 of steel or the like. The cable 46 is covered by a sheath or cover 48 for example of plastics material and is conveniently "dead" or substantially without resilience so that it will remain in any form or position into which it is placed. At the end remote from the buckle socket portion the cable 46 has an apertured end fitting 50 by which it and thus the socket portion can be anchored for example to a vehicle floor.

In use, with the buckle socket and tongue portions initially separated, the tongue 12 is inserted into the socket defined by the frame member floor and side walls and its free end engages the latch portion 30 to depress the latch assembly against the action of the leaf springs 38 until the latching edge 14 of the tongue passes the latch portion, when the springs cause the latch assembly to return to the position shown, in which the two buckle parts are securely held together. It will be noted that forces tending to separate the tongue portion from the socket portion are transmitted by the latch plate 28 directly to the frame member 24 which is secured to the steel cable 46. The housing 22 carries no part of such forces.

Release of the two buckle parts is effected simply and reliably by manual depression of the release member 36, the movement of which carries with it the latch plate 28 so that the latch portion 30 is withdrawn from the aperture in the tongue 12 to the level of the floor 25, allowing the tongue to be removed from the socket. To facilitate removal of the tongue 12, the frame member 24 mounts a pair of ejection springs 52, in the form of coiled compression springs, and an ejection member 54, in the form of flat U-shaped moulding or pressing. The limbs 55 of the U-shape member 54 extend forwardly from the base and are guided in the frame member 24 in substantially the same way as the tongue 12 is guided on insertion into the socket. Extending rearwardly from the base is a pair of pins 56 received in the springs 52, which are also guided by the side walls 27 and which abut at their inner ends against lugs 57 formed on the frame member 24. Thus the member 54 is urged by the ejection springs against the free end of the tongue 12 to oppose its entry and assist its withdrawal.

FIGS. 4 and 5 show a second buckle 100 embodying the invention in which the latch assembly is retained in its normal or latching position, with the latch plate 28 urged against the underside of the floor 25 of the frame member, by a spring 102 in the form of a spring steel rectangular leaf spring. The spring 102 acts between the inturned edges of the frame member side walls 27 and a release member 136 the shape of which differs slightly from the release member 36 of FIGS. 1, 2 and 3 to locate the spring.

In the buckle of FIGS. 4 and 5, the ejection member is again U-shaped with forwardly projecting limbs 155 but only a single ejection spring 152, again a compression coil spring, is provided. A rearwardly extending projection 156 of the ejection member is received in the spring, the other end of which abuts a lug 157 of the frame member 124. The frame member is connected to a flexible metal cable 146 by means of a thimble 144.

This buckle thus offers the advantage as compared with that of FIGS. 1, 2 and 3 that the spring 102 is contained between the latch assembly and the frame member, so that these components are operatively complete in themselves and do not depend functionally on the housing.

FIGS. 6 and 7 show a third embodiment of the invention in which release movement of the latch assembly is effected indirectly rather than by direct manual actuation of the assembly as in the two preceding embodiments.

In the third illustrated buckle 200 the release member 236 has a top surface which instead of being planar or otherwise shaped to constitute a push-button, is provided with a ramp portion 237 rising gradually from the upper surface in the direction away from the socket mouth, and of arcuate cross section. A pivot pin 202 extends between the cases 240, 242 forming the buckle housing, at right angles to plane of movement of the tongue 12, and a release element 204 is pivoted on the pin. The release element 204 has a plate-like push member 205 having a pair of apertured lugs 206, 207 extending perpendicularly from an inner surface thereof, the pin 202 being received through the apertures in the lugs. The lug 206 extends over the surface of the release member 236 and has a wedge shaped cam portion 208 (FIG. 7) on the surface facing the release member. The outer face of the push member is accessible to manual operation through mating recesses 210, 211 in the side walls of the cases 240, 242 located adjacent the socket mouth, the outer face normally being inclined to the direction of movement of the tongue. A spring 209 is provided to urge the release element 204 to this normal position, defined by abutment of the push member with the side walls of the cases adjacent the recesses 210, 211, the spring suitably being a tension coil spring extending between the housing and the lug 206.

In the normal position of the release element 204, the tongue 12 can enter the socket, its free end depressing the latch portion 30 so that insertion can be completed, when the latch portion engages the latching edge 14 to lock the two buckle portions together, as with the previous embodiments. To release the two buckle portions, the release element 204 is pivoted normally inwardly by pressure on the push member 205 so that the wedge shaped cam portion 208 of the release element attempts to ride up the ramp portion 237 of the release member 236, whereby the release member and thus the whole latch assembly is moved downwardly to disengage the latch portion 30 from the tongue 12, so effecting buckle separation.

Figure 8:
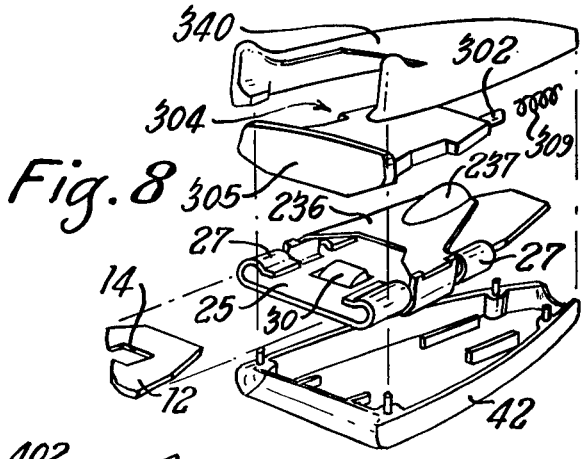
FIG. 8 is an exploded perspective view of a fourth buckle embodying the invention.

In the fourth buckle embodying the invention, shown in FIG. 8, the release member 236 again has the ramp portion 237 formed on the upper surface thereof, and release of the buckle is effected by a release element 304. The element 304 is guided in internal ridges of the upper housing case 340 for sliding movement parallel to the direction of insertion of the tongue 12. The outer end of the release element 304 is formed as a manually despressible push member 305 accessible in a recess formed in the case 340 adjacent the mouth of the socket, the case preventing movement of the element outwardly beyond the recess. A pair of coil springs 309 act between abutments on the case 340 and the inner end of the element 304 which is provided with pins 302 protruding into the springs. Between the pins 302, the inner end of the element 304 is formed as a cam engageable with the ramp portion 237 on inward movement of the element against the springs 309, so as to cause the release movement of the whole latch assembly at right angles to the direction of movement of the element.

Figure 9:
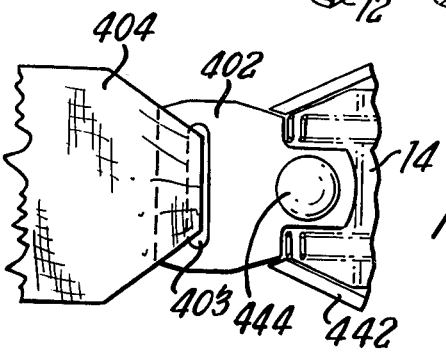
FIG. 9 is a partial view resembling that of FIG. 1 of a fifth buckle embodying the invention.

It will be evident from the foregoing description of the third and fourth embodiments, which of course include such features of the first and/or second embodiments as are appropriate, that the basic buckle structure of the invention is readily adaptable to a variety of means for effecting release. FIG. 9 shows a fifth embodiment constituted by a modification of any of the buckles of the invention so far described to enable this to be connected to a vehicle anchorage position by means of length of webbing instead of a flexible wire cable. Accordingly, the rear or inner end of the frame member 14 is secured by a rivet 444 to an end fitting 402 having the form of a plate which widens externally of the buckle housing, of which only the lower case 442 is shown, to a portion which is slotted at 403 to receive the end of a length of webbing 404. Instead of the fitting 402, a bracket can be secured to the frame member 14 so that the buckle socket portion can be ridigly mounted within the vehicle. The fitting or the bracket can be made integrally with the frame member.

Figure 10:
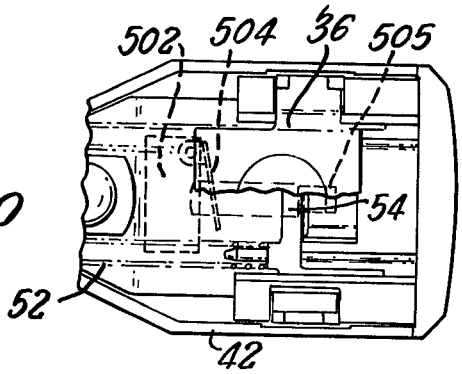
FIG. 10 is a partial view resembling that of FIG. 1 of a sixth buckle embodying the invention.
Figure 11:
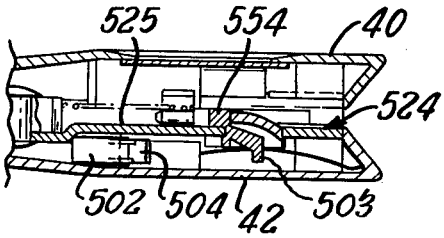
FIG. 11 is a partial view resembling that of FIG. 2 of the buckle of FIG. 10.

In FIGS. 10 and 11 are shown a sixth buckle embodying the invention constituted by the buckle of FIGS. 1, 2 and 3 modified to incorporate an electric circuit element of which a condition is dependent on the presence or absence of the tongue 12 within the socket. The circuit element comprises a microswitch 502 received on the base of the lower case 42 of the buckle housing, between this base and the underside of the floor 525 of the frame member 524, and having an operating lever 504 pivoted thereon. The ejection member 554 is modified to have a lip 503 protruding downwardly through a slot 505 in the floor 525. In the released or separated position of the buckle, the ejection member 554 is in its forward position with the lip spaced from the lever 504. Insertion of the tongue 12 drives the member 554 rearwardly so that the lip 503 engages the lever and actuates the switch. The condition of the switch is thus changed and is changed again on withdrawal of the tongue which disengages the lip from the lever 504. The provision of the micro-switch or other condition responsive circuit element enables the buckle of the invention to be employed in seat belt systems in which warning is given of non-use of the seat belt or in which operation of the vehicle is inhibited because of such non-use.

It will be understood that features of the various embodiments described can be interchanged between them as appropriate. Directional expression for example "upwardly" and "downwardly" are used only for convenience of description. The buckles can be employed in any desired orientation and with seat belt systems of any desired configuration.

We claim:

1. A buckle for a vehicle seat belt system, the buckle comprising a tongue portion having a latch formation, a socket portion, wall means in said socket portion defining a socket having a mouth through which said tongue portion can be inserted into said socket, an aperture in said wall means, and a latch means having a latch portion, the latch means extending around said wall means and being movable relative thereto between a latching position in which said latch portion extends into said socket through said aperture for engagement with said latch formation when said tongue portion is received in the socket, whereby the tongue portion is retained within the socket, and a release position in which the tongue portion can be withdrawn from the socket, means biasing said latch means into the latching position, surfaces formed on said wall means, the surfaces extending transversely of the direction of movement of said tongue and facing away from said mouth, surfaces on said latch means extending transversely of the direction of movement of said tongue for engagement with said wall means surface, said wall means comprising a plate having the aperture, and integral side walls curving upwardly from respective opposed edges of the plate and then towards each other to define the socket, cut-outs in said side walls providing said surfaces.

2. The buckle of claim 1 wherein the latch means is guided by said cut-outs for movement in a direction at right angles to said plate.

3. The buckle of claim 1 wherein the portion of said latch means providing said surfaces is integrally formed with said latch portion.

4. The buckle of claim 1 wherein said latch means comprises a release portion and a base portion, said base portion having the latch portion, and said release and base portions substantially spanning the socket on opposite sides thereof.

5. The buckle of claim 1 wherein said plate and side walls define the socket mouth.

6. The buckle of claim 5 wherein the mouth of the socket is defined by said guide member plate and side portions.

7. A buckle for a vehicle seat belt system, the buckle comprising a tongue portion having a latch formation, a socket portion, wall means in said socket portion defining a socket having a mouth through which said tongue portion can be inserted into said socket, an aperture in said wall means, and a latch means having a latch portion, the latch means extending around said wall means and being movable relative thereto between a latching position in which said latch portion extends into said socket through said aperture for engagement with said latch formation when said tongue portion is received in the socket, whereby the tongue portion is retained within the socket, and a release position in which the tongue portion can be withdrawn from the socket, means biasing said latch means into the latching position, surfaces formed on said wall means, the surfaces extending transversely of the direction of movement of said tongue and facing away from said mouth, surfaces on said latch means extending transversely of the direction of movement of said tongue for engagement with said wall means surface, said wall means comprising a plate portion having the aperture and integral side walls curving upwardly from respective opposed sides of the plate portion and then toward each other to form the socket, said side walls providing said wall means surfaces and wherein said latch means comprises a plate portion and integral side walls extending from respective opposed sides of the latch means plate portion, the latch means plate portion underlying said wall means plate portion and having the latch portion, and said latch means side walls having said latch means surfaces.

* * * * *